US008616399B2

(12) United States Patent
Milkowski et al.

(10) Patent No.: US 8,616,399 B2
(45) Date of Patent: Dec. 31, 2013

(54) RECLOSABLE CONTAINER LID HAVING A COVER MEMBER

(75) Inventors: Bogumil Milkowski, Gdansk (PL); Dariusz Lewandowski, Warszawa (PL); Andrzej Toborowicz, Warszawa (PL)

(73) Assignee: Commodum Arkadiusz Kaczmarski, Gdansk (PL)

( * ) Notice: Subject to any disclaimer, the term of this patent is extended or adjusted under 35 U.S.C. 154(b) by 826 days.

(21) Appl. No.: 12/446,554

(22) PCT Filed: Oct. 19, 2007

(86) PCT No.: PCT/PL2007/000070

§ 371 (c)(1),
(2), (4) Date: Apr. 21, 2009

(87) PCT Pub. No.: WO2008/051099

PCT Pub. Date: May 2, 2008

(65) Prior Publication Data

US 2010/0308048 A1 Dec. 9, 2010

(30) Foreign Application Priority Data

Oct. 23, 2006 (PL) ..... 380896

(51) Int. Cl.
*B65D 51/18* (2006.01)

(52) U.S. Cl.
USPC ..... 220/254.1; 220/254.3; 220/255.1; 220/716

(58) Field of Classification Search
USPC ..... 220/906, 254.1, 254.3, 254.4, 258.1, 220/258.3, 258.5, 255.1, 268–270, 272, 220/273, 716, 359.1, 257.2, 257.1, 254.2; 413/14–16
See application file for complete search history.

(56) References Cited

U.S. PATENT DOCUMENTS

| | | | | |
|---|---|---|---|---|
| 3,977,578 | A | 8/1976 | Perry | |
| 4,183,443 | A * | 1/1980 | DeParales et al. | 220/714 |
| 4,244,488 | A * | 1/1981 | Fridl et al. | 220/260 |
| 4,717,039 | A | 1/1988 | Ayyoubi | |
| 4,781,323 | A * | 11/1988 | Elias et al. | 229/123.3 |
| 6,220,470 | B1 * | 4/2001 | McHenry et al. | 220/254.4 |

FOREIGN PATENT DOCUMENTS

| | | | |
|---|---|---|---|
| DE | 4200614 | A1 | 3/1993 |
| EP | 1247752 | A | 10/2002 |
| EP | 1688355 | A | 8/2006 |
| WO | 9812118 | A | 3/1998 |
| WO | 0044635 | A | 8/2000 |
| WO | 2004056667 | A | 7/2004 |

OTHER PUBLICATIONS

International Search Report dated Mar. 4, 2008 from the corresponding PCT/PL2007/000070.

* cited by examiner

*Primary Examiner* — Steven A. Reynolds
*Assistant Examiner* — Javier A Pagan
(74) *Attorney, Agent, or Firm* — Katten Muchin Rosenman LLP

(57) ABSTRACT

Disclosed is a plastic lid for a container, which has a mounting hole in the lid's center and an in-and-out hole that is tightly closed until opened for the first time, and which has a plastic opening mechanism that can additionally pivotally cover the in-and-out hole. The opening mechanism has a valve that has a hole around which there are at least two latches which interact with a knob that has an arm terminated with a cylindrical element that has at least one carrier and is able to rotate in the mounting hole. The valve and the knob are sealed and immobilized with a plastic foil. Once opened, the in-and-out hole can be covered again using the valve and the mouth contact area using a plastic hygienic cover.

12 Claims, 8 Drawing Sheets

RECLOSABLE CONTAINER LID HAVING A COVER MEMBER

Figure 1:
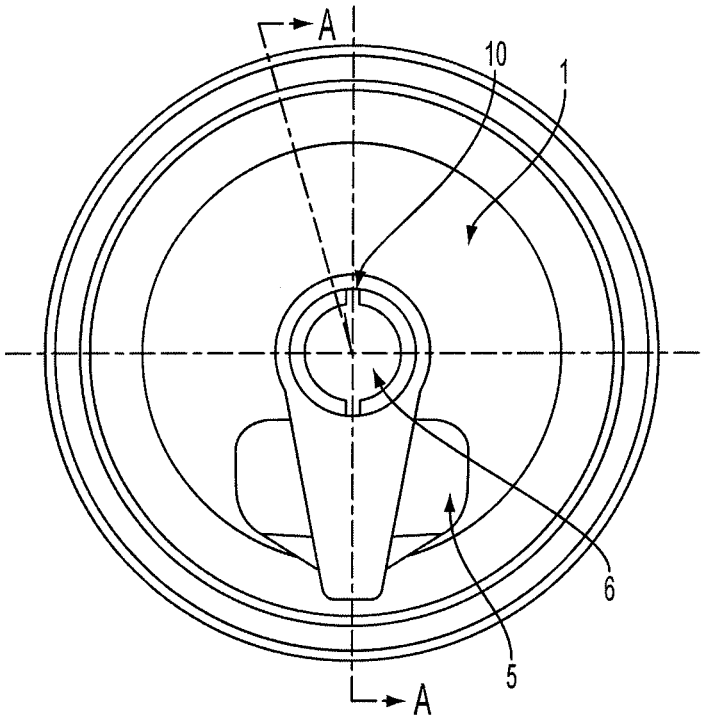

This invention is concerned with a plastic end closure of a container that is primarily intended for beverages. It ensures a tight closure before the container is opened for the first time and may be used to cover the opening.

Such an end closure is known from Patent Application PCT/DE97/02061 (WO 98/12118) concerning a container, in particular a drinks can, which is closed by a lid with a finger pull-tab opening. The container has also a rotatable lid element that enables the re-closing of the pull-tab opening for as long as needed.

A re-closable lid, in particular for a drinks can, is also known from the international Patent Application PCT/EP2003/014675 (WO 2004/056667). In this solution, the lid has a strip-away part that can be torn along the predetermined score line and a finger tab that is rotatably mounted onto the lid wall. The finger tab is fitted with a freely twistable portion and a flat closure attachment underneath the grip, which enables the re-closure of the opening.

The end closure consists of a body that is tightly attached to the container and an opening device that additionally enables one to cover the opening after use. The invention is concerned with an end closure that is characterised by that it has an in-and-out hole in its body, which is tightly closed until opened for the first time using a valve that has a hole around which, substantially perpendicularly to the hole surface, there are at least two latches that are rotatably mounted in the mounting hole from the inside of the end closure and interact with a knob that has an arm terminated with a cylindrical element that has at least one carrier on its side surface and is rotatably mounted in the mounting hole from the outside of the end closure, whereby the valve is sealed and immobilised from the internal side of the end closure with the help of the plastic foil in which there is a hole with an area that is less than the area of the base of a cylindrical element and which is attached to the end closure's internal surface alongside the edge of the valve and to the surface of the base of the cylindrical element along the edge of the hole in the foil. The end closure's body has preferably a dome shape and the valve's plane section has a shape close to a circular sector.

The valve's surface on the opposite side of the latches consists of two flat surfaces that have a common edge along the chord of the valve's arch. Each latch has a flange and a transverse cross section in the form of a transverse cross section of a hollow cylinder sector.

The inside surface of the end closure's body preferably has a groove that runs around the edge of the valve being in its initial position. The sealing foil is sealed into this groove. Preferably, a mounting hole is in the centre of the end closure's body.

Furthermore, the end closure is fitted with a hygienic cover protecting the mouth contact area. The hygienic protection may be provided the surface of the arm of the knob, which is facing the outside surface of the end closure, and has a shape close to a circular sector, or by a hygienic cover firmly fitted in a hole in the arm of the knob or by a hygienic cover in the form of a removable overlay that is snapped onto the cylindrical element of the knob.

According to this invention, the end closure ensures tightness in high pressures generated inside the container filled with a carbonated beverage, and serves as a device enabling easy and comfortable opening of the container, even in cases where the end closure has been deformed by high pressures inside the container. Once opened, the valve can be used to cover the hole again to protect the beverage against contamination and the additional hygienic cover protects the mouth contact area.

Figure 2:
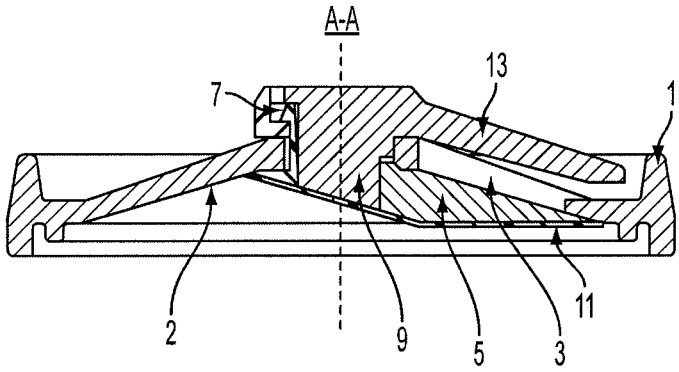
Figure 3:
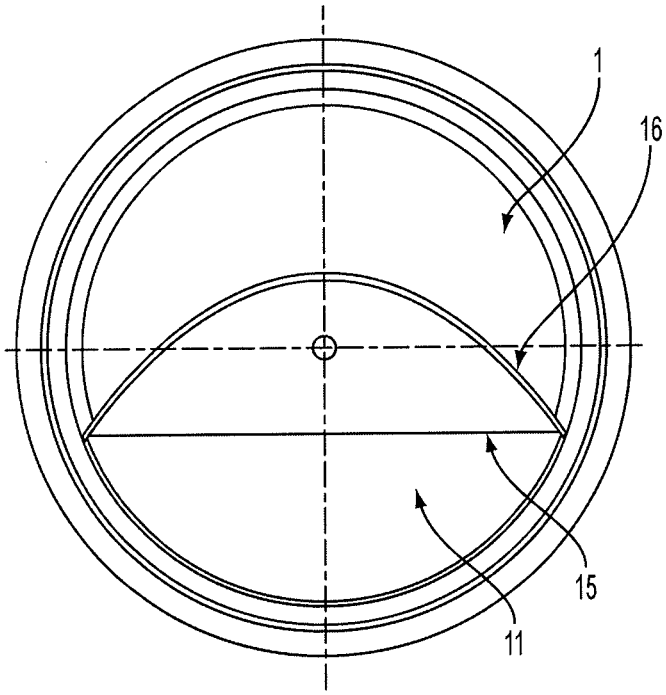
Figure 4:
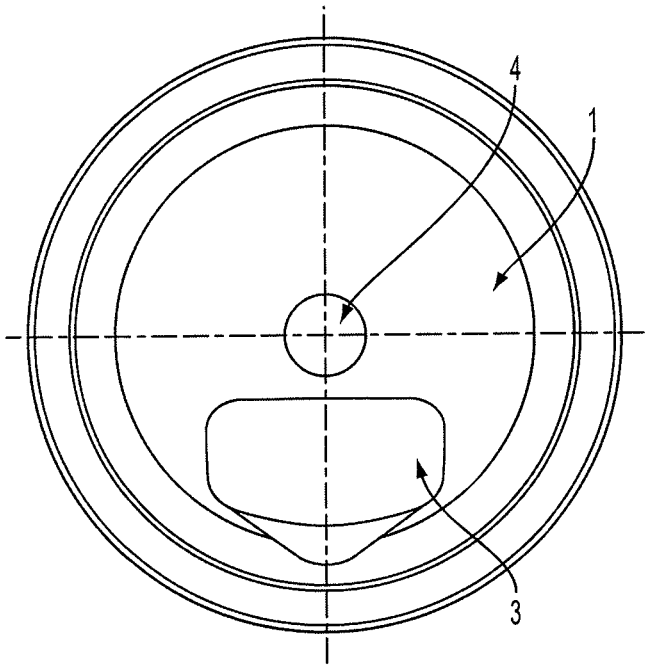
Figure 5:
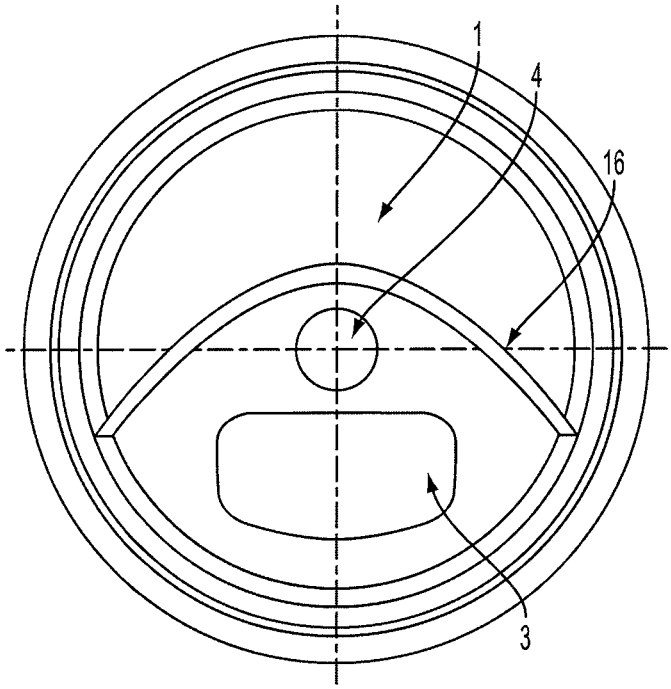
Figure 6:
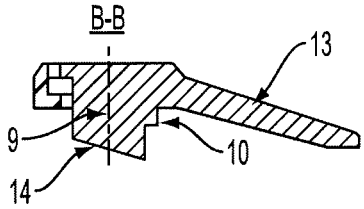
Figure 7:
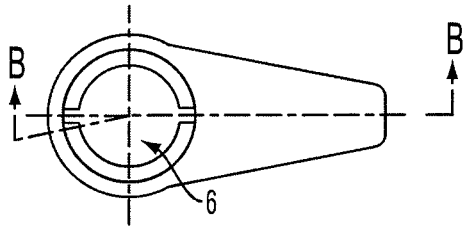
Figure 8:
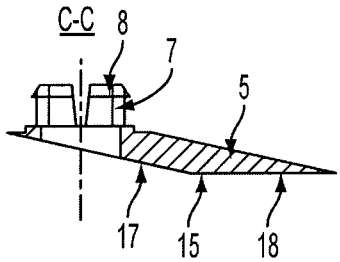
Figure 9:
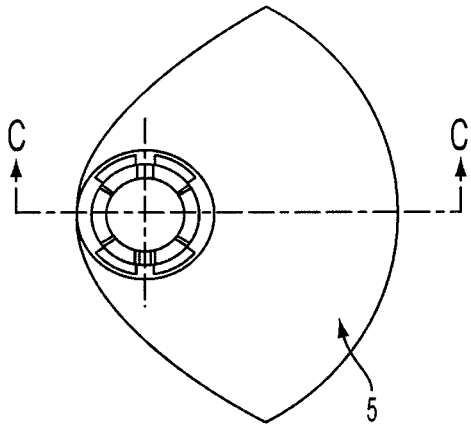
Figure 10:
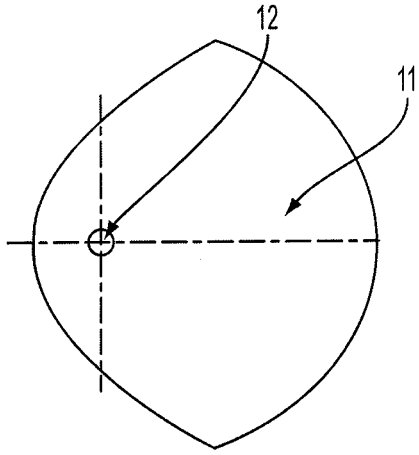
Figure 11:
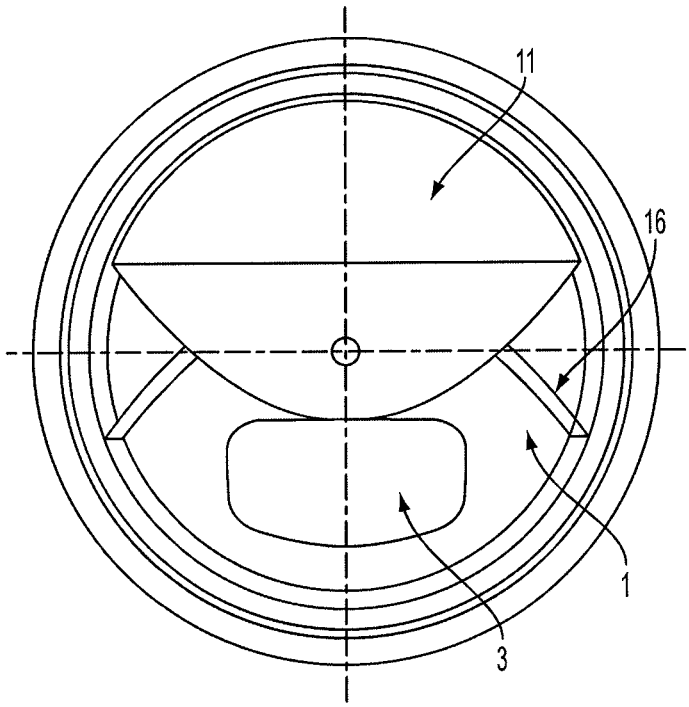
Figure 12:
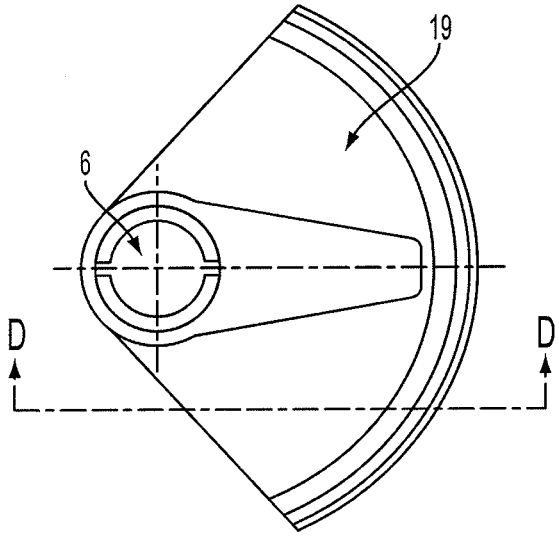
Figure 13:
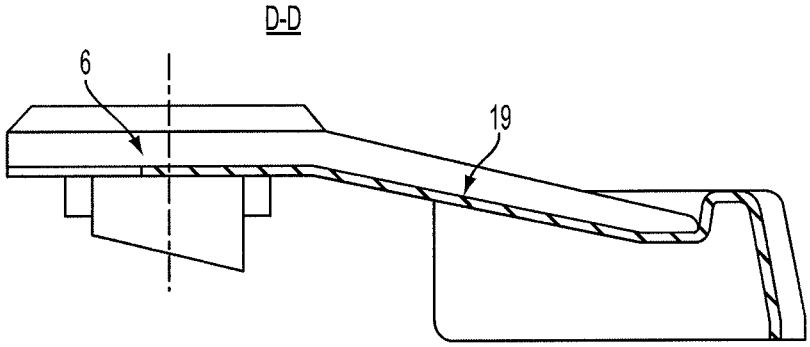
Figure 14:
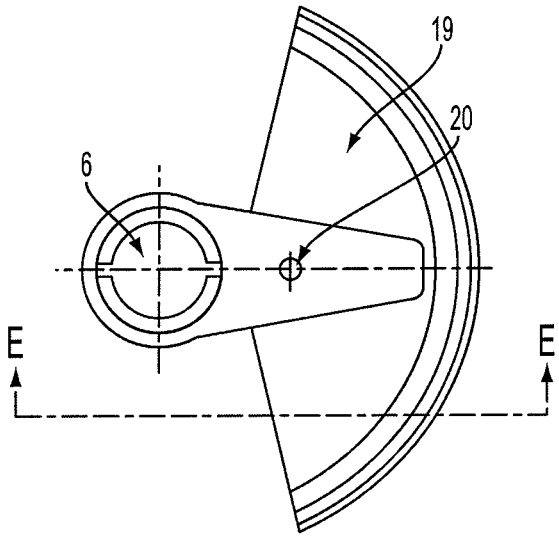
Figure 15:
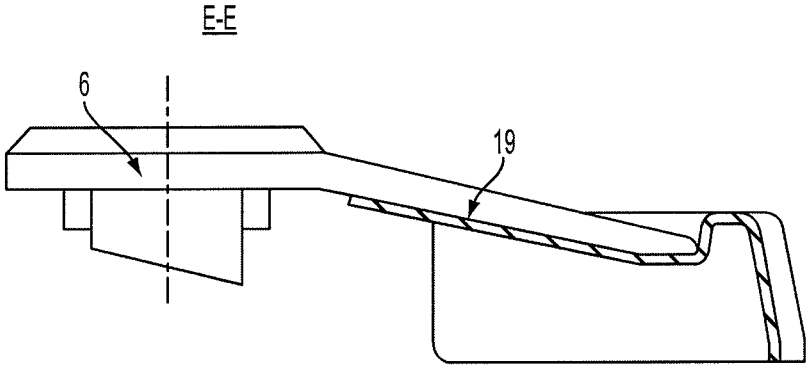
Figure 16:
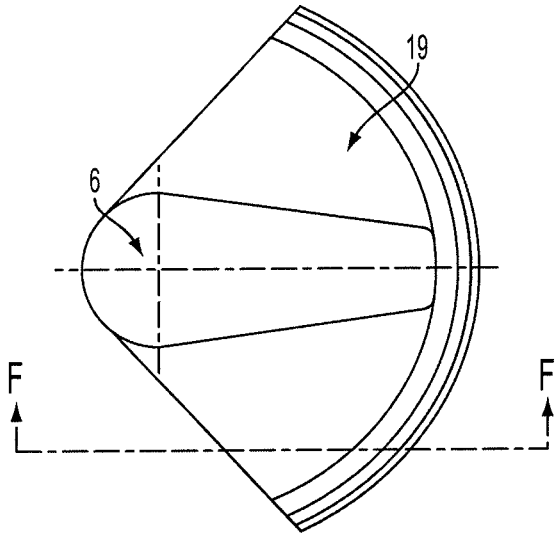
Figure 17:
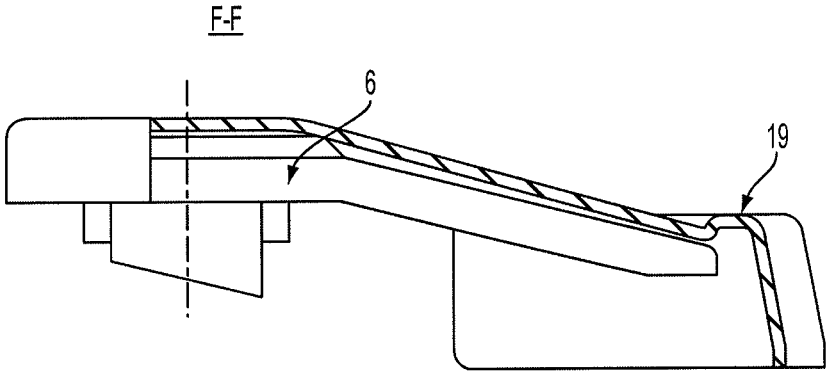

The invention will now be described by way of example and with reference to the accompanying drawings in which:

FIG. 1 presents the end closure in a closed position—view from above;

FIG. 2—A cross-section of the end closure;

FIG. 3—the end closure in a closed position—view from below;

FIG. 4—The body of the end closure in a view from above, prior to the valve and knob installation;

FIG. 5—the body of the end closure in a view from below, prior to the valve and knob installation;

FIG. 6—A cross-section of the knob;

FIG. 7—The knob in a view from above;

FIG. 8—A cross-section of the valve;

FIG. 9—The valve—view from above;

FIG. 10—Plastic foil;

FIG. 11—The end closure in an open position in a view from below;

FIG. 12—The knob and hygienic cover as a one-unit system—view from above;

FIG. 13—A cross-section of the knob and hygienic cover as a one-unit system;

FIG. 14 The knob with a hygienic cover mounted on its arm;

FIG. 15 A cross-section of the knob with a hygienic cover mounted on its arm;

FIG. 16—The knob with a snap-on hygienic cover—view from above,

FIG. 17—A cross-section of the knob with a snap-on hygienic cover.

The end closure shown by way of example consists of a stationary body 1 whose inside surface 2 has a dome shape. The body 1 has a in-and-out hole 3 and a centrally situated mounting hole 4 used for the mounting of the end closure's mobile parts including a valve 5 and knob 6. The valve 5 valve has a hole around which, substantially perpendicularly to the hole surface, there are four latches 7 terminated with a flange 8, which are rotatably mounted in the mounting hole 4 from the inside of the end closure. A plane section of the valve 5 has a shape close to a circular sector and the valve's surface, on the opposite side of the latches 7, it consists of two planes 17 and 18 which have a common edge 15 running along the chord of the edge arch of the valve 5. The latches 7 interact with a knob 6 fitted with an arm 13 terminated with a cylindrical element 9 that has two carriers 10 on its side surface and that is rotatably mounted in the mounting hole 4 on the outside of the body 1 of the end closure. The valve 5 is sealed and immobilised on the end closure's inside surface using plastic foil 11 that has a hole 12 with an area that is less than the area of the base 14 of the cylindrical element 9. The inside surface 2 of the body 1 has a groove 16 to which the plastic foil 11 is sealed and which runs along the edge of the valve 5 when the valve is in the initial position. The foil is also sealed into the surface of the base 14 of the cylindrical element 9 along the edge of the hole 12 in the plastic foil 11.

Furthermore, the end closure is fitted with a hygienic cover 19 of the mouth contact area.

The hygienic protection is provided by surface of the knob's arm 13, which is facing the outside surface of the end closure, and has a shape close to a circular sector (FIG. 13). In another example the cover 19 is firmly placed in a hole 20 in the knob's arm 13 (FIG. 14).

The hygienic cover 19 can also take the form of a removable sheath snapped onto the top part of the cylindrical element 9 of the knob 6.

In order to open the container one should rotate the arm 13 of the knob 6 overcoming resistance until the in-and-out hole 3 is fully uncovered (FIG. 11). By rotating the arm 13 back, one can cover the hole 3 and the mouth contact area with the cover 19.

The invention claimed is:

1. A reclosable container lid comprising:

a body having a top side and a bottom side, wherein the body has formed therein a mounting hole and an insertion hole; and an opening mechanism comprising:

a valve having an edge and a valve hole, wherein, substantially perpendicular to the valve, there are at least two latches around the valve hole, and wherein the latches are inserted through the mounting hole from the bottom side of the body; and a knob comprising an arm and a cylindrical element, the cylindrical element having at least one carrier, wherein the latches of the valve engage the carrier so that the valve and the knob are rotatable about the mounting hole; and wherein the cylindrical element is able to freely rotate in the valve hole until the carrier engages the latches; and a plastic foil having a foil hole with a diameter less than the diameter of the cylindrical element, wherein the plastic foil is sealed to a bottom surface of the cylindrical element and alongside the edge of the valve.

2. The reclosable container lid of claim 1, wherein the bottom side of the body has a domed shape.

3. The reclosable container lid of claim 1, wherein a plane section of the valve has a shape substantially close to a circular sector.

4. The reclosable container lid of claim 3, wherein the valve has a surface comprising two planes that have a common edge.

5. The reclosable container lid of claim 1, wherein the latches have flanges.

6. The reclosable container lid of claim 1, wherein a transverse cross-section of each latch has the form of a transverse cross-section of a hollow cylinder sector.

7. The reclosable container lid of claim 1, wherein a groove is located on the bottom side of the body along an edge of the plastic foil.

8. The reclosable container lid of claim 1, wherein the plastic foil is sealed to the bottom side of the body.

9. The reclosable container lid of claim 1, wherein the mounting hole is bored in the center of the body.

10. The reclosable container lid of claim 1, wherein a bottom of the arm of the knob is fitted with a plastic element that has a shape substantially close to a circular sector and serves as a hygienic cover.

11. The reclosable container lid of claim 10, wherein the plastic element is fitted in a hole in the arm of the knob.

12. The reclosable container lid of claim 10, wherein the plastic element is snapped to the knob.

* * * * *